US005348201A

United States Patent [19]

Koo

[11] Patent Number: 5,348,201

[45] Date of Patent: Sep. 20, 1994

[54] FLIP TOP CLOSURE

[75] Inventor: James Y. C. Koo, Strasburg, Pa.

[73] Assignee: Kerr Group, Inc., Lancaster, Pa.

[21] Appl. No.: 49,914

[22] Filed: Apr. 20, 1993

[51] Int. Cl.[5] ..... B65D 55/02

[52] U.S. Cl. ..... 222/556; 222/153; 215/221; 220/281

[58] Field of Search ..... 215/221; 220/281, 283; 222/153, 556, 546

[56] References Cited

U.S. PATENT DOCUMENTS

| | | | |
|---|---|---|---|
| 2,206,118 | 7/1940 | Pahls et al. . | |
| 3,556,331 | 1/1971 | Towns . | |
| 3,584,760 | 6/1971 | Grinker . | |
| 3,604,585 | 9/1971 | Towns . | |
| 3,826,394 | 7/1974 | Stull | 215/9 |
| 4,047,495 | 9/1977 | O'Brian | 215/224 |
| 4,209,100 | 6/1980 | Uhlig | 215/216 |
| 4,220,262 | 9/1980 | Uhlig et al. | 222/153 |
| 4,371,095 | 2/1983 | Montgomery et al. | 222/153 |
| 4,420,089 | 12/1983 | Walker et al. | 215/216 |
| 4,424,910 | 1/1984 | Heinol | 215/216 |
| 4,444,326 | 4/1984 | Musel | 215/209 |
| 4,533,058 | 8/1985 | Uhlig | 215/216 |
| 4,629,081 | 12/1986 | McLaren | 222/153 |
| 4,696,408 | 9/1987 | Dubach | 215/237 |
| 4,727,999 | 3/1988 | Gach | 215/232 |
| 4,747,498 | 5/1988 | Gach | 215/232 |
| 4,776,475 | 10/1988 | La Vange | 215/216 |
| 4,787,525 | 11/1988 | Joyce | 215/201 |
| 4,790,442 | 12/1988 | Gach | 215/216 |
| 4,807,768 | 2/1989 | Gach | 215/216 |
| 4,821,898 | 4/1989 | Smalley | 215/216 |
| 4,826,026 | 5/1989 | Gach et al. | 215/206 |
| 4,832,218 | 5/1989 | Gibilisco | 215/221 |
| 4,838,441 | 6/1989 | Chernack | 215/216 |
| 4,892,208 | 1/1990 | Sledge | 215/216 |
| 4,940,167 | 7/1990 | Fillmore et al. | 222/153 |
| 4,984,716 | 1/1991 | Beck | 222/153 |
| 5,255,823 | 10/1993 | Tichy et al. | 222/153 |

FOREIGN PATENT DOCUMENTS 2158048 11/1985 United Kingdom .

*Primary Examiner*—Andres Kashnikow
*Assistant Examiner*—Christopher G. Trainor
*Attorney, Agent, or Firm*—Kenyon & Kenyon

[57] ABSTRACT

An improved flip top closure device for a dispensing opening of a container, comprising a first body member with a flip top adapted to be mounted on the container, and a second body member mounted on the first body member and having a part which is usually in overlapping relation with the flip top to prevent opening thereof, which part is displaceable from said overlapping relation to expose the edge of the flip top for opening thereof and which, by virtue of spring tabs which provide restorative force, will return to the overlapping position without need for external physical manipulation.

8 Claims, 6 Drawing Sheets

FLIP TOP CLOSURE

FIELD OF THE INVENTION

The present invention relates to child resistant closures and particularly to an improved flip top closure.

BACKGROUND OF THE INVENTION

Hinged closures, also referred to as "flip top" closures incorporate a base and a lid. The base is adapted to engage a closure, and incorporates a top surface having an opening. The lid is attached to the base by a connection such as a hinge so that the lid is movable, relative to the base, between closed and open positions. In the closed position, the lid overlies the top surface of the base and occludes the opening, whereas in the open position the lid is remote from the opening. When the base is secured to the mouth of a container, the lid controls access to the contents of the container. The base, lid and hinge may be molded as elements of a single, integral piece of plastic material.

Various attempts have been made to provide child resistant flip top closures having features which impede opening of the lid by a child but which permit opening of the lid by an adult. Such child-resistant features are useful where the closure is employed on a container holding a toxic: or otherwise hazardous material.

British patent application No. 2 158 048 A discloses a flip top cap having a ring movably mounted to the base. In the normal position of the ring, the ring protrudes upwardly from the base and surrounds the lid when the lid is in the closed position. Thus, the periphery of the lid is inaccessible, and a child cannot engage the lid to move it from the closed position to the open position. An adult can move the ring downwardly relative to the base so as to gain access to the lid, but a child normally cannot accomplish the required twisting and sliding motion. The closure shown in U.S. Pat. No. 3,584,760, utilizes a guard ring rotatable relative to the base with a separate spring for biasing the guard ring. These features add cost and complexity to such a device, and, significantly, suffer from the disadvantage that the covering member must be physically manipulated back from the uncovered to the covered position. In other words, without such manipulation after use of the closure, the container contents remain accessible to children.

Others have attempted to make a satisfactory child resistant flip top closure having all of its elements molded in a single piece. As disclosed in U.S. Pat. Nos. 3,556,331 and 3,604,585, the lid may have an elongated, rectangular shape, whereas the base may have a narrow slot in its top surface. When the lid is in its closed position, it is recessed within the slot in the top surface of the base. The parts are dimensioned so as to provide only a very narrow opening at the end of the lid remote from the hinge so that the lid can be opened only by an adult capable of engaging a tool or fingernail within this narrow opening. U.S. Pat. No. 4,047,495 describes a child resistant closure wherein the base is provided with an upstanding rim or wall around its top surface, such that the lid is recessed within this rim when in the closed position. The base is also provided with a projection adjacent the middle of the top surface so that the underside of the lid bears on the projection. The lid can be opened by forcing its rearward portion, adjacent the hinge, downwardly, towards the base. The projection on the base acts as a fulcrum, causing the forward portion of the lid to lift upwardly and hence to project above the rim on the base. In this condition the forward portion of the lid can be engaged and pulled upwardly, away from the base so as to swing the lid to its open position U.S. Pat. No. 4,371,095 utilizes a similar arrangement. U.S. Pat. No. 4,533,058 employs an elongated, strap-like lid received in an elongated slot extending entire across the top surface of the base from the rear or hinge side to the front side. The base is provided with a cam surface such that when the distal portion of the strap-like lid, remote from the hinge, is forced downwardly, the tip of the lid is forced outwardly at the front cf base. The outwardly projecting tip can be engaged and pulled upwardly.

U.S. Pat. No. 4,444,326 discloses a flip top closure having a base integral with the container body itself and incorporating a peripheral wall on the base which can be forced inwardly at one location so as to expose the underside of the lid for manual engagement. U.S. Pat. No. 4,209,100 shows a further child resistant closure having a lid which recessed in the top surface of the base when the lid is in the closed position. The base has an upstanding peripheral wall abutting the forward portion of the lid, remote from the hinge. This peripheral wall is arranged so that it can be forced inwardly, towards the lid. The lid and peripheral wall are provided with cam surfaces so that inward motion of the peripheral wall will move the lid upwardly, away from its closed position to a partially open position. In this partially open position, the lid protrudes above the top surface of the base and hence is accessible for manual engagement by the user.

A further child resistant closure is disclosed in U.S. Pat. No. 3,826,394. The closure of the U.S. Pat. No. 3,826,394 includes a lid having a projection at the distal extremity of the lid, remote from the hinge. The projection extends forwardly adjacent the forward edge of the base when the lid is in the closed position. A pair of guard members mounted on the forward edge of the base define a vertically extensive slot. The projection on the distal end of the lid is disposed in the slot when the cap is in the closed position. In some embodiments of the U.S. Pat. No. 3,826,394 closure, such as those shown in FIGS. 4–6 and 7–9 thereof, a flat, plate-like tab extends between the guard members or projects upwardly in the slot between the guard members. The tab confronts the distal extremity of the projection on the lid. To open the lid, the tab is flexed forwardly and hence away from the lid and a finger or fingernail is inserted under the projection.

Each of the aforementioned closures leaves something to be desired with respect to resistance to opening by a child, ease of opening by an adult, manufacturing cost, appearance and other important factors. Despite the extensive efforts made by the art heretofore towards development of a truly satisfactory child resistant flip top closure, there remains a need for still further improvements.

ADVANTAGES AND SUMMARY OF THE INVENTION

Accordingly, it is an advantage of the present invention to provide a flip top closure device for a dispensing opening of a container, comprising a first body member with a flip top adapted to be mounted on the container, and a second body member mounted on the first body member and having a part which is usually in overlapping relation with the flip top to prevent opening thereof, which part is displaceable from said overlapping relation to expose the edge of the flip top for opening thereof and which part is automatically returned to the overlapping position without need for external physical manipulation.

It is another advantage of the present invention to provide a child-resistant flip top closure for sealing an open-topped container having an external screw thread formed on the neck of the container, the closure comprising an outer cap having a first top end wall and a first skirt depending from the outer edge thereof; an inner cap having a second top end wall, a flip top and a dispensing aperture formed through said second top end wall, and an internally threaded second skirt depending from the outer edge thereof for engagement with the external screw thread on the container, the outer cap overlying the inner cap and being concentric therewith; the first top end wall of the outer cap having a second aperture large enough to receive the flip top; and a plurality of spring tabs integrally attached to and extending radially upwardly from said second top end wall; such that when the outer cap and inner cap are assembled, the first skirt of the first top wall being in overlapping relation with said flip top and said spring tabs contacting the underside of the first top wall of the outer cap so as to exert upward axial pressure on said first top wall so as to maintain the first skirt's overlapping relation with said flip top.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DESCRIPTION OF THE PREFERRED EMBODIMENTS

Figure 1:
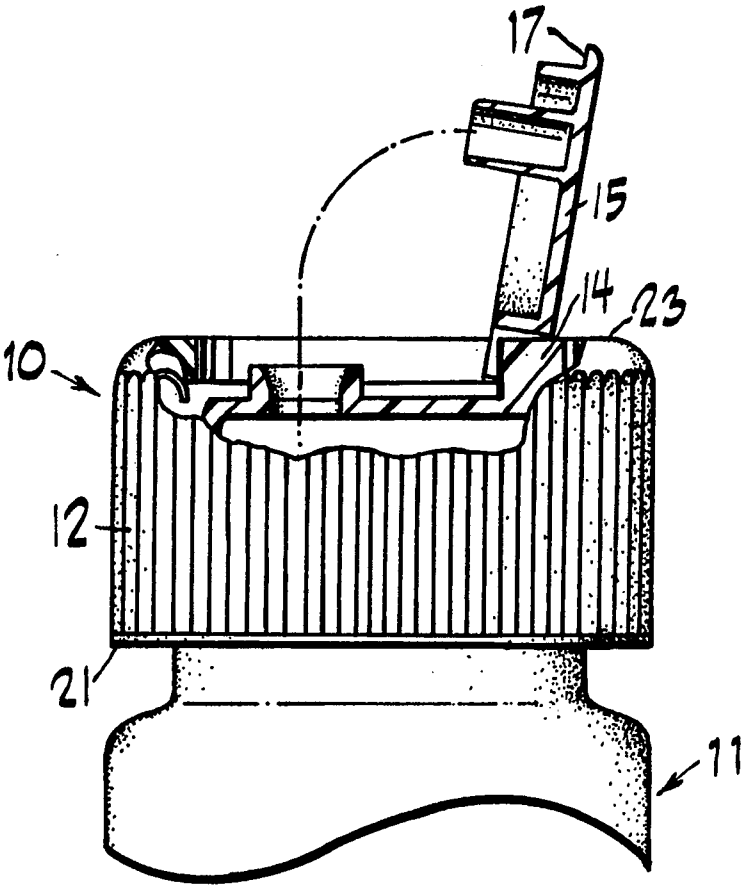
FIG. 1 is a side elevational view, partly in longitudinal section, of a first embodiment of a flip top closure device according to the invention, with a cap protection element in the normal position and an inner cap flap element in a raised position.
Figure 3:
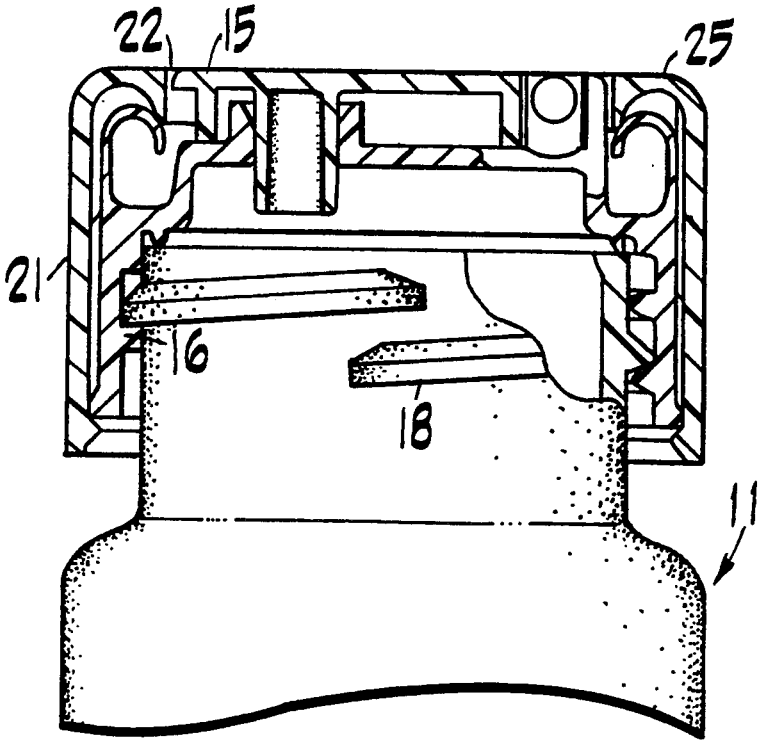
FIG. 3 is a side elevational view of the flip top closure of FIG. 1, partly in longitudinal section with the cap element in the normal position.
Figure 4:
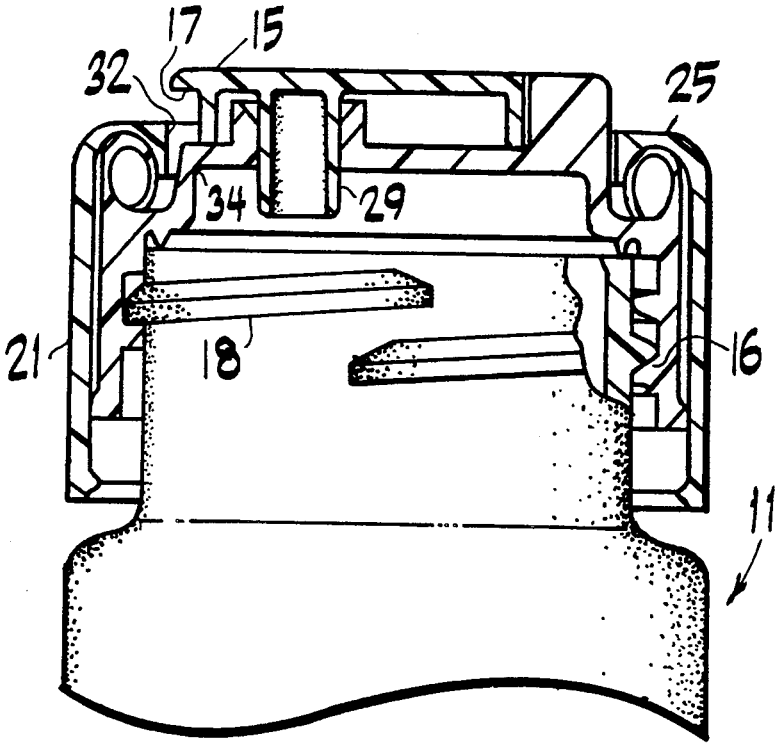
FIG. 4 is a side elevational view of the flip top closure of FIG. 1, partly in longitudinal section with the cap element in the depressed release position.
Figure 5:
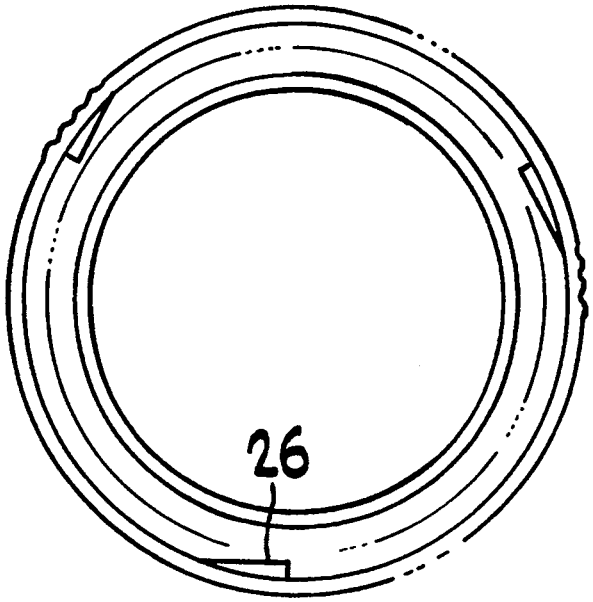
FIG. 5 is a plan view of the flip top closure of FIG. 1 looking at the underside of the cap element and illustrating ratchet elements.

Turning to the drawings (FIGS. 1–9, and particularly FIGS. 1, 3 and 4) there is shown a child-resistant, two-piece closure, generally indicated by 10, fastened to a container indicated generally by 11. The closure 10 includes an outer cap 12 having an end wall 23 and a skirt 21 depending therefrom overlying an inner cap 14 having a flip top 15 and a dispensing aperture 19 formed through an upper wall 30.

The inner and outer caps are concentrically aligned and are preferably formed in single pieces by molding a relatively hard resilient plastic such as polypropylene. To fasten the closure 10 to the container 11, a generally cylindrically shaped skirt 13 of the inner cap 14 is formed with a container fastening means such as a spiral screw thread 16 which cooperates with a corresponding shaped screw thread 18 on the container 11.

The outer cap member 12 is formed with a circular top panel 25 integrally molded with the depending skirt portion 21 and having a through aperture 22 large enough to receive the flip top 15. Molded on the inner side 24 of depending skirt 21 are a plurality of ramp members 26 (see FIG. 5) which cooperate in a ratchet relationship with corresponding members 28 located on the outside 30 of the inner cap's skirt member 13 (see FIG. 6). Also depending from the top panel 25 about the circumference of aperture 22 is a second skirt member 32, whose function is described in detail below.

Figure 11:
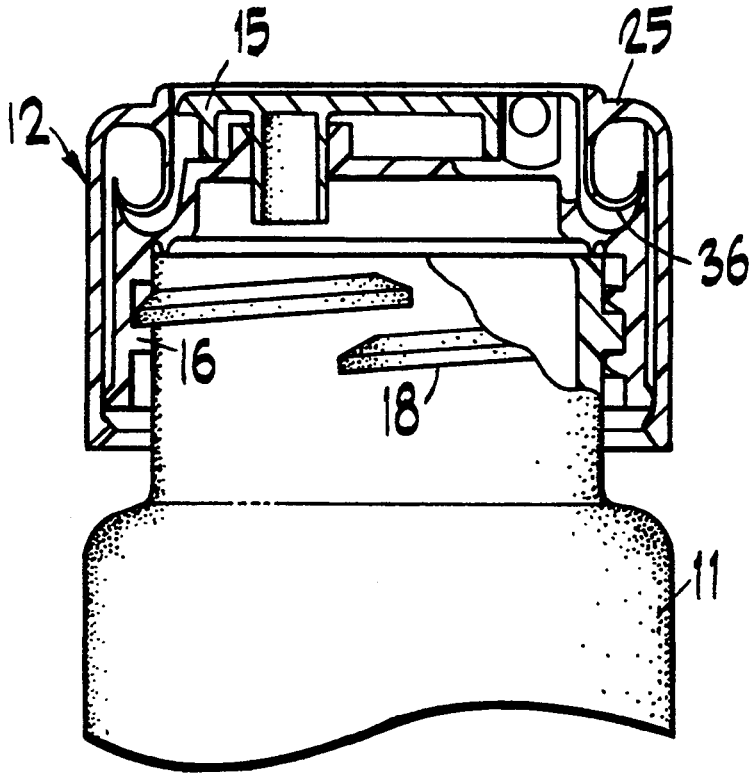
FIG. 11 is a side elevational view, partly in longitudinal section, of a third embodiment of a flip top closure device of the invention.

The depending skirt 13 of the inner cap member 14 has axially extending radial ramps 28, which, as described below, function in ratchet engagement with corresponding ramp members 26 on the inner side of outer cap depending skirt 21. Extending radially upwardly from the edge of end wall 30 and skirt 13, along an axis parallel to that of the skirt, is at least three, and preferably four, spaced integrally molded spring tabs 36. As will be appreciated by those skilled in the art, the actual shape of the spring tabs is irrelevant, so long as they provide the desired restorative force (as described in further detail below). In addition, the spring tabs may be located on the outer cap, as is depicted in FIG. 11. The number of spring tabs 36 effects the amount of force required to depress the outer cap member 12 for access to the flip top 15 (described in more detail below) and, significantly, returns the outer cap member to the child resistant position without need for external physical manipulation. In other words, return of the outer cap to overlapping relation with the inner cap is automatic.

Figure 2:
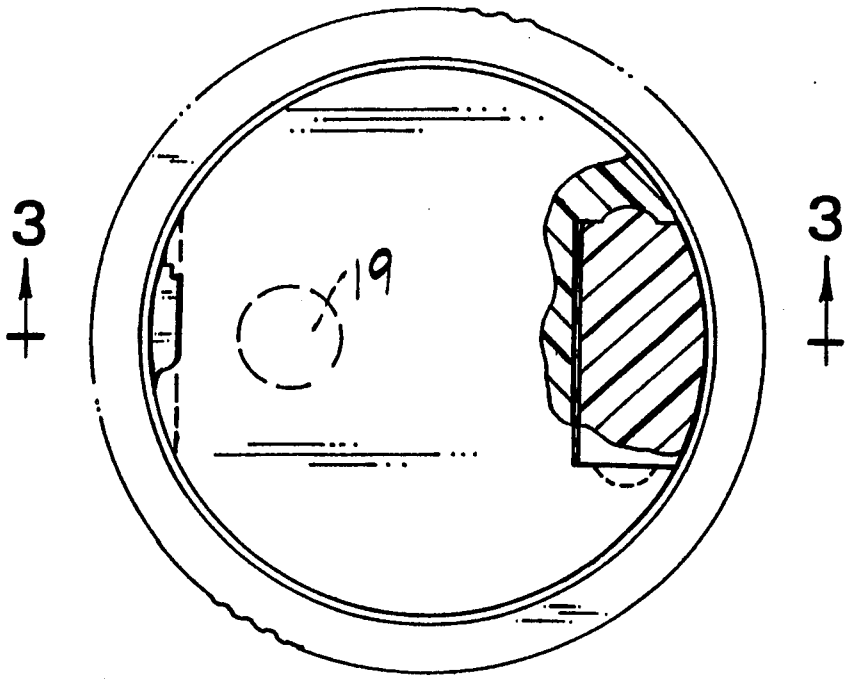
FIG. 2 is a top plan view of the flip top closure of FIG. 1 showing a partial section of the hinge element.
Figure 7:
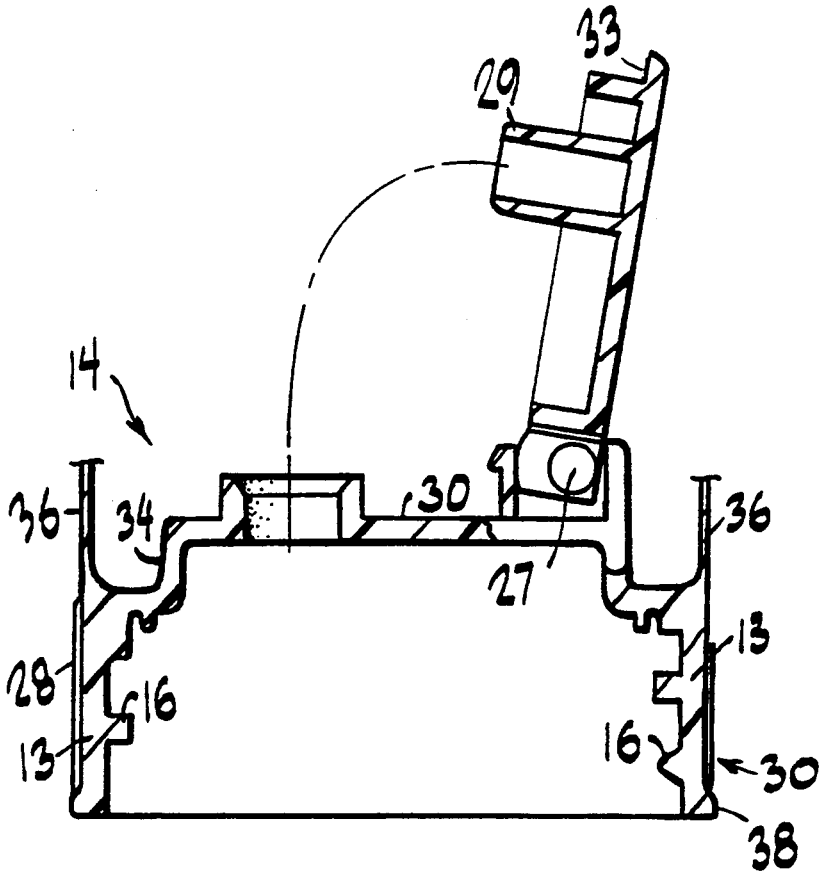
FIG. 7 is a side elevational view, partly in longitudinal section, of the inner cap element with the flap element in a raised position.
Figure 8:
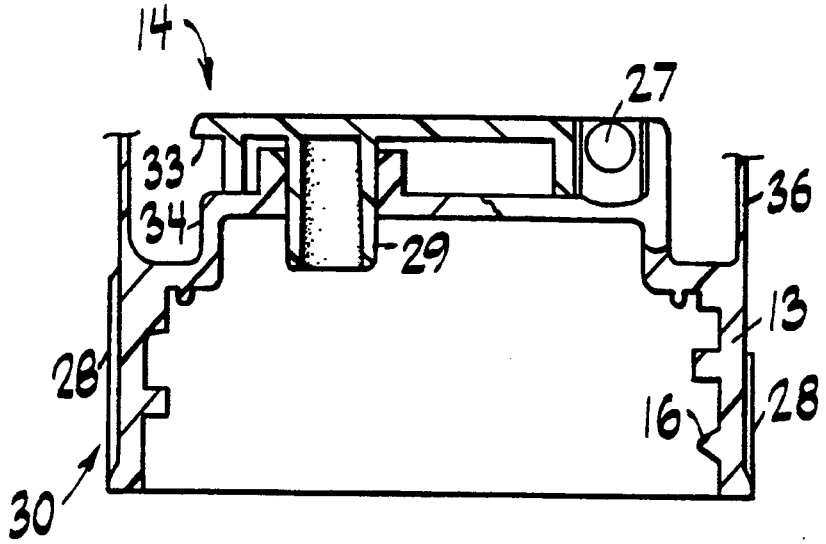
FIG. 8 is a side elevational view, partly in longitudinal section, of the inner cap element with the flap element in a lowered or closed position.
Figure 9:
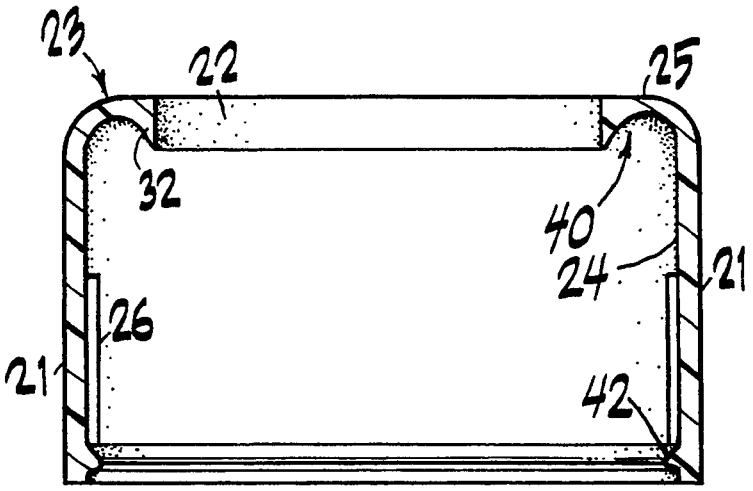
FIG. 9 is a side elevational view, partly in longitudinal section, of the outer cap element.

The end wall 30 of the inner cap member 14 mounts the flip top 15 by an integral connector or hinge 27. For reasons which will become obvious, the flip top 15 and hinge 27 element are mounted on a platform member 34 which is inset from the skirt 13 a distance which corresponds with the distance between skirt members 21 and 32 of the outer cap 12. The flip top 15 has a spigot 29 for plugging the dispensing aperture 19 in the usual closed position. Naturally, there is no limitation in the size of the aperture and associated spigot, their size depending on the intended contents of the container (e.g., liquid, lotion, powders, or tablets). The flip top 15 also has opposite the hinge 27 a rebate providing a lip 33 by which the flip top can be pivoted upwardly (as viewed)

about the hinge 27 from the FIG. 8 position to the FIG. 7 position. FIG. 2 is a top plan view of the inner cap member 14 showing a partial section of a preferred construction for the hinge 27 and a partial cut-away view of the undercut which forms the lip 33. As will be appreciated by those skilled in the art, multiple configurations may be used for the hinge; e.g., a ball and socket hinge.

Closure 10 is formed by assembling the outer cap member 12 and the inner cap member 14. To assemble the completed closure 10, a retention bead 42 of outer cap member 12 is forced over a corresponding retention bead 38 of inner cap member 14. The process of assembling the two cap members further causes the spring tabs 36 to contact the underside 3.2 of the outer cap's end wall and, by virtue of the arrangement and shape of skirts 21 and 32, bend into a U-shape. When the closure 10 is fully assembled, the bent spring tabs 36 exert upward axial pressure on the underside 40 of end wall, assuring that without externally applied downward axial pressure on the outer cap member, it will remain in the child resistant position.

In use, the closure device 10 is mounted on a container 11 by screw engagement of the threads 16 with threads 18 of the container 11. The closure device 10 is in the usual, closed, position shown in FIG. 3 with the entire peripheral edge of the flip top 15, including the hinge 27, overlapped by the skirt 21 of the outer cap member 14. In other words, in normal position the skirt 21 is in overlapping relation with the flip top 15 to prevent access to the lip 33 and opening thereof, which part 15 is displaceable from said overlapping relation to expose an edge 17 of the flip top 15 for opening thereof. The flip top 15 can therefor not be operated as it is not possible to apply upward pressure to the lip 17 to lift the flip top (thus rendering the closure child resistant).

If it is desired to dispense some contents, the entire outer cap 12, including particularly the skirt member 21 is displaced axially downwardly by applying downward pressure on skirt member 21. The result is that skirt member 21 is removed from overlapping engagement with the edge of the flip top 15, thus exposing the lip 33 (See FIG. 4). Upward pressure on lip 33 then flips the flip top 15 to the FIG. 1 position so that the dispensing aperture 19 is unplugged. The closure is returned to the FIG. 3 configuration by returning the flip top 15 to plug the dispensing aperture 19. Concurrently, by virtue of upward axial pressure exerted by the spring tabs 36 (i.e., restorative force), skirt 21 overlaps the peripheral edge of the flip top 15 so that opening thereof is obviated. Molded on the inner side 24 of depending skirt 21 are a plurality of ramp members 26 (see FIG. 5) which cooperate in a ratchet relationship with corresponding members 28 located on the outside 30 of the inner cap's skirt member 13.

Figure 6:
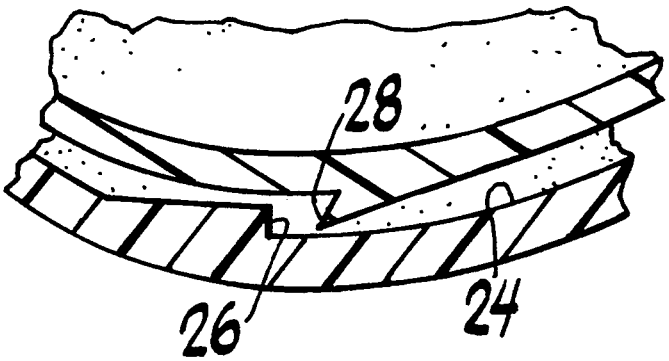
FIG. 6 is an exploded partial view of the cap element illustrating a ratchet mechanism for contact with an outer cap element.

Turning now to FIG. 6, in order to install the closure on a container, movement of the outer cap member 12 in the clockwise direction causes engagement of ramp members 26 with corresponding ramp members 28, thereby causing the closure to torque on to the container. By contrast, once the closure has been applied to the container with sufficient torque, turning the outer cap member in the counterclockwise direction causes ramps 26 and 28 to ride over one another, thereby preventing the undesired removal of the closure from the container. As will be appreciated by those skilled in the art, there are many other construction methods available to prevent the undesired removal of the closure from the container.

Figure 10:
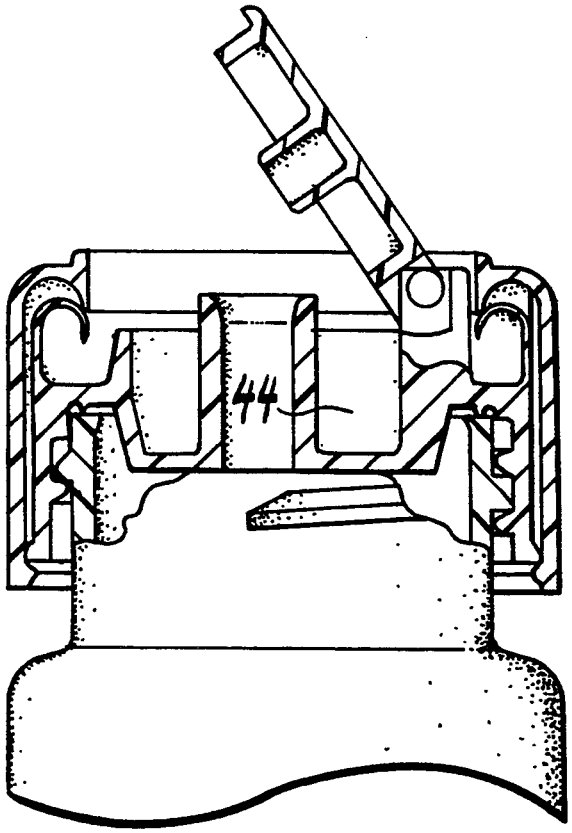
FIG. 10 is side elevational view, partly in longitudinal section, of a second embodiment of a flip top closure device according to the invention, with the cap protection element in the normal position and the inner cap flip top element in a raised position.

Turning to FIG. 10, there is illustrated a second preferred embodiment for use where the container is intended to accommodate a liquid. By way of background, the use of the closure configuration of the first embodiment may be problematic if the intended contents of the container are a liquid or, more likely for pharmaceuticals, a lotion. In such event, it is possible that the liquid/lotion will pool around the aperture 19, thereby inhibiting closing of the flip top 15 lid portion by interfering with its hinge operation.

This potential problem is obviated by the construction of a closure in the form of the second embodiment where a recessed well 44 is provided to accommodate spillage. In practice, then, any liquid/lotion which remains after dispensing will collect in the recessed well 44, rather than around the upper wall 30 of inner cap 14, thereby obviating any interference with the flip top mechanism.

Thus, it can be seen that an improved flip top closure is provided by the present invention. While preferred embodiments of the invention has been shown and described herein, there is no intent to limit the invention by this description. On the contrary, the invention is intended to cover all modifications and alternatives falling within the scope of the accompanying claims.

I claim:

1. A flip top closure device for a dispensing opening of a container, comprising a first body member with a flip top adapted to be mounted on the container and an aperture providing access to the dispensing opening of the container, and a second body member mounted on the first body member and having a part which in its normal position is in overlapping relation with the flip top to prevent opening thereof, which part is displaceable from said overlapping relation to expose an edge of the flip top for opening thereof, and which part is returned to overlapping position with the flip top without need for external physical manipulation by virtue of spring members located on one of sad body members which produce a restorative force on the second body member.

2. The closure of claim 1 wherein the flip top of the first body cannot be raised and the corresponding aperture accessed without displacing the second body member.

3. The closure of claim 1 wherein the spring members are located on an upper wall of the first body member.

4. The closure of claim 1 wherein the spring members are located on an upper wall of the second body member.

5. A child-resistant flip top closure for sealing an open-topped container having an external screw thread formed on a neck of the container, the closure comprising:

an outer cap having a first top end wall and a first skirt depending from an outer edge thereof;

an inner cap having a second top end wall, a flip top and a dispensing aperture formed through said second top end wall, and an internally threaded second skirt depending from an outer edge of said second top end wall for engagement with the external screw thread on the container, the outer cap overlying the inner cap and being concentric therewith;

the first top end wall of the outer cap having a second aperture large enough to receive the flip top;

a plurality of spring tabs integrally attached to and extending radially upwardly from said second top end wall;

such that when the outer cap and inner cap are assembled, the first skirt of the first top wall is positioned in overlapping relation with said flip top and said spring tabs contact the underside of the first top wall of the outer cap so as to exert upward axial pressure on said first top wall so as to maintain the first skirt's overlapping relation with said flip top.

6. The flip top closure of claim 5 wherein the flip top is attached to the second top end wall by virtue of a hinge arrangement.

7. The flip top closure of claim 6 wherein the hinge arrangement is of the ball and socket hinge type.

8. The flip top closure of claim 5 further comprising:

first ratchet teeth on an inner face of the first skirt member of the outer cap abutting with corresponding ramp members on the inner face of the second skirt member of the inner cap when the outer cap is turned in the application direction to rotate the two caps together and causing the internal threads on the inner cap to cooperate with the external screw threads on the container to fasten the closure on the container; and the first ratchet teeth on the first skirt member of the outer cap member ramping over the ramp members of the inner face of the second skirt member when a reverse torque is applied on the outer cap member, thereby preventing inadvertent removal of the closure from the container.

* * * * *